US007870957B2

(12) United States Patent
Holley, Jr. et al.

(10) Patent No.: US 7,870,957 B2
(45) Date of Patent: Jan. 18, 2011

(54) CARTON WITH INSERT AND DISPENSER

(75) Inventors: John M. Holley, Jr., Lawrenceville, GA (US); Bradford J. Walling, Raleigh, NC (US); Garrett K. Schemmel, Savannah, GA (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 259 days.

(21) Appl. No.: 12/089,502

(22) PCT Filed: Oct. 10, 2006

(86) PCT No.: PCT/US2006/039562

§ 371 (c)(1),
(2), (4) Date: Aug. 20, 2008

(87) PCT Pub. No.: WO2007/044719

PCT Pub. Date: Apr. 19, 2007

(65) Prior Publication Data

US 2009/0314663 A1 Dec. 24, 2009

Related U.S. Application Data

(60) Provisional application No. 60/725,537, filed on Oct. 7, 2005.

(51) Int. Cl.
*B65D 65/00* (2006.01)

(52) U.S. Cl. ..... 206/427; 206/499; 229/122.1

(58) Field of Classification Search ..... 206/499, 206/427, 429, 139, 433; 229/122.1
See application file for complete search history.

(56) References Cited

U.S. PATENT DOCUMENTS

| | | | | |
|---|---|---|---|---|
| 3,066,843 | A | 12/1962 | Johnson | |
| 3,121,511 | A * | 2/1964 | Whitehead | 221/283 |
| 4,530,548 | A * | 7/1985 | Spamer et al. | 312/45 |
| 4,591,090 | A | 5/1986 | Collins et al. | |
| 5,020,670 | A * | 6/1991 | Bedford | 206/499 |
| 5,797,236 | A | 8/1998 | Posey, Jr. et al. | |
| 6,253,930 | B1 * | 7/2001 | Freidus et al. | 211/59.2 |
| 7,743,972 | B2 * | 6/2010 | Fogle | 229/120.18 |

(Continued)

FOREIGN PATENT DOCUMENTS

DE 9006550 U1 8/1990

(Continued)

*Primary Examiner*—Jacob K Ackun, Jr.
(74) *Attorney, Agent, or Firm*—MWV Intellectual Property Group

(57) ABSTRACT

A package (10) includes a plurality of articles (B) that are disposed on their sides in a matrix arrangement that includes a plurality of rows (R1, R2, R3) and columns (C1, C2, C3, C4). A lower row (R1) of articles (B) defines a dispensing position (P1) for each column (C1, C2, C3, C4) and upper rows (R2, R3) of articles (B) define descending positions (P2, P3) for each column (C1, C2, C3, C4). A carton (500) encloses the articles (B) and includes a detachable portion (1115, 1315) that can be detached along a severance line (1110, 1310) to expose the articles in the dispensing positions (P1). Inserts (400, 800, 1000) are provided to facilitate dispensing the articles, to control the rate of descent of articles moving from the descending positions (P2, P3) toward the dispensing positions (P1), and/or to provide insulation between the articles as they move toward the dispensing positions (P1).

18 Claims, 7 Drawing Sheets

U.S. PATENT DOCUMENTS

| | | | | |
|---|---|---|---|---|
| 2005/0085364 | A1 | 4/2005 | Spivey, Sr. | |
| 2005/0103674 | A1* | 5/2005 | Matheou | 206/503 |
| 2006/0027639 | A1* | 2/2006 | Rasmussen | 229/122.1 |
| 2006/0180488 | A1* | 8/2006 | Spivey et al. | 206/427 |

FOREIGN PATENT DOCUMENTS

| | | |
|---|---|---|
| GB | 1420024 | 1/1976 |
| GB | 2252546 A | 8/1992 |

* cited by examiner

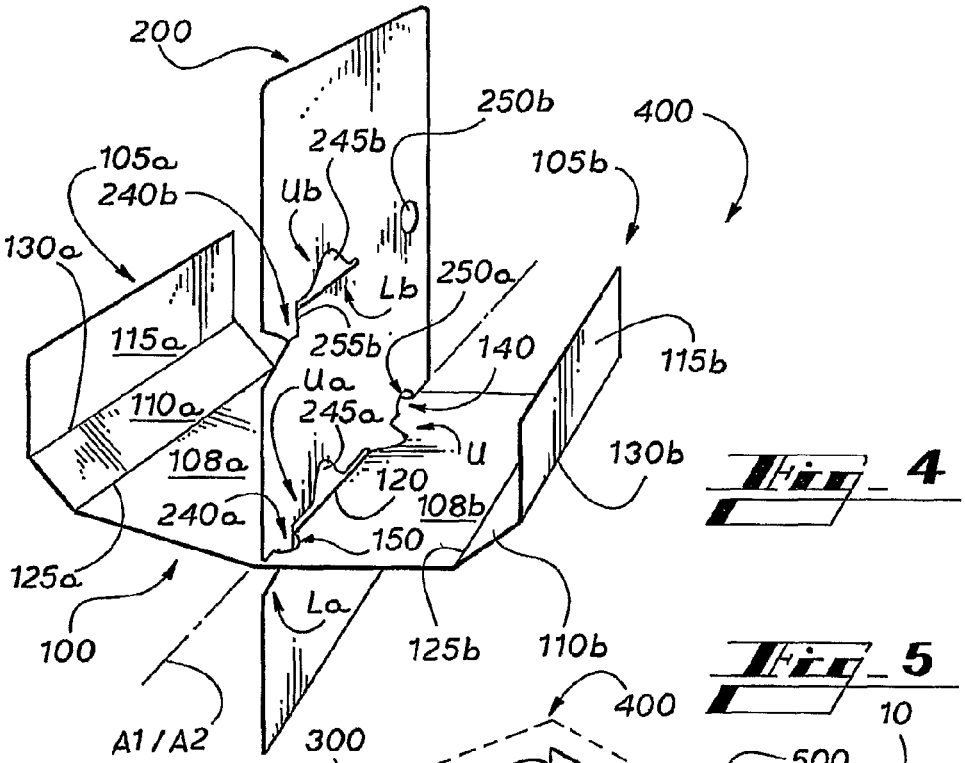
Fig. 4
Fig. 5
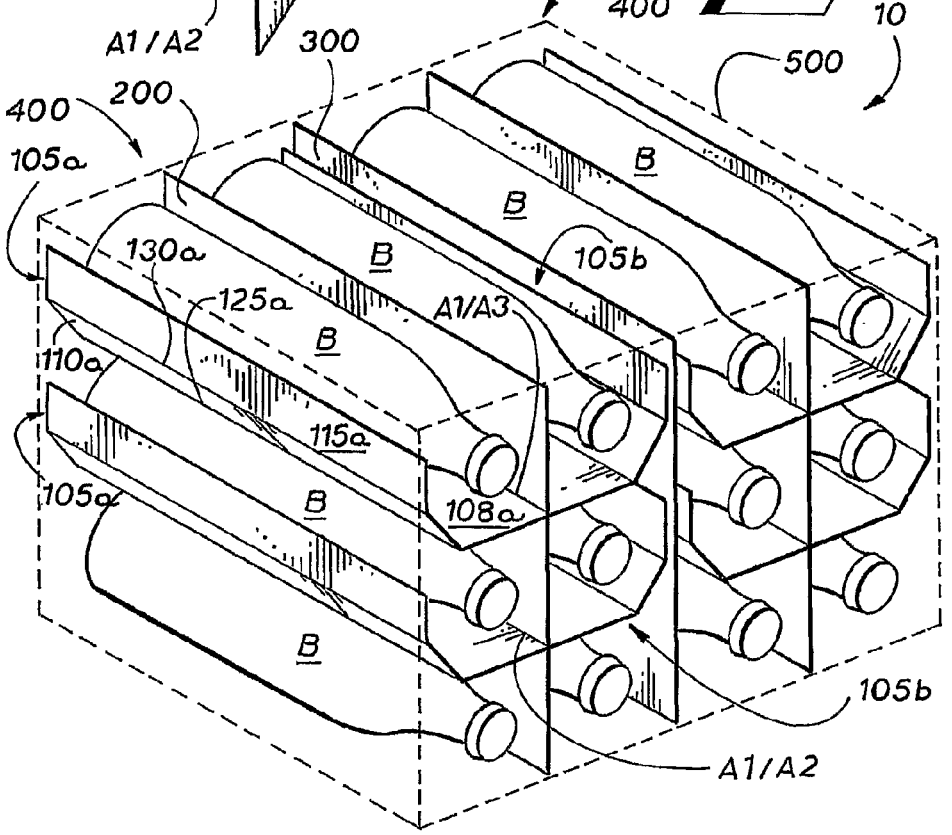

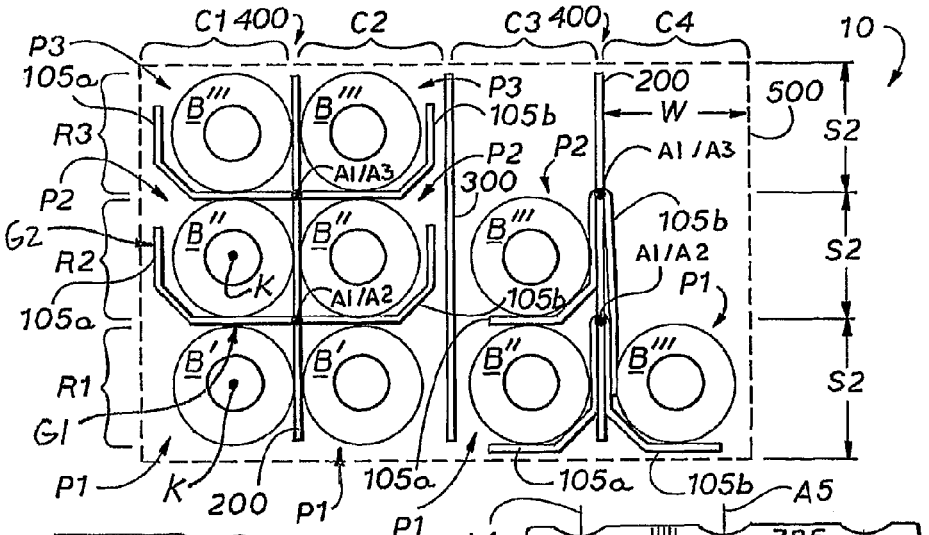
Fig_6
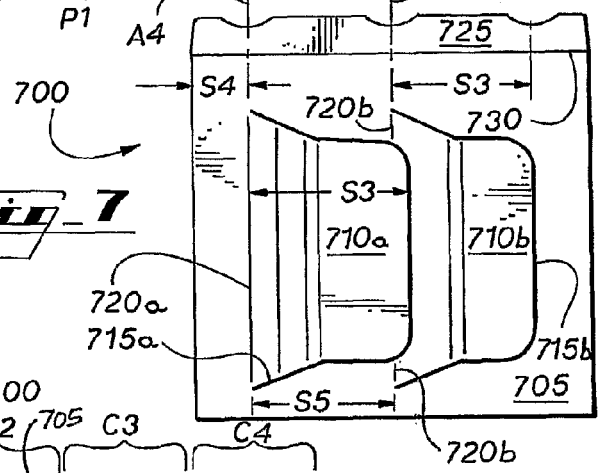
Fig_7
Fig_9
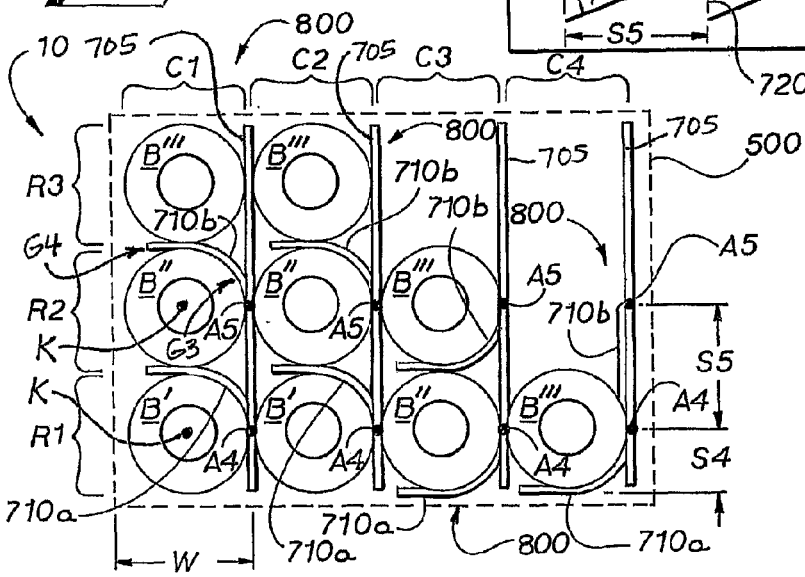

CARTON WITH INSERT AND DISPENSER

CROSS REFERENCE TO RELATED APPLICATION

This application claims priority to U.S. Application No. 60/725,537, filed Oct. 7, 2005, the entirety of which is incorporated herein by reference.

TECHNICAL FIELD

This invention relates generally to cartons, and specifically to cartons that facilitate transportation, storage, and dispensing of breakable articles.

BACKGROUND OF THE INVENTION

In cartons that enclose articles such as bottles, it is often desirable to provide a way to conveniently dispense the articles. The bottles are typically vertically oriented on their ends, supported by the bottom wall of the carton, and dispensed through an opening in the top wall of the carton such that a user can easily access the articles from above. For example, when the carton rests on a surface a user can grasp the end of an article and pull it through the opening.

In certain environments, it is not convenient to access bottles that through an opening in the top wall of the carton. For example, when the carton is placed in a refrigerator, access to the space above the carton is limited. In such environments, the carton can be oriented on its side such that the bottles are horizontally oriented on their sides and are accessible through the opening in the top wall. However, in this orientation, the bottles are not supported by the carton but rather pile on top of one another. Thus, the bottles crash or bump against one another as articles are removed or dispensed from the carton and this can potentially damage the labels on the bottles or the bottles themselves. In cartons where one or more partitions are provided to insulate the articles from one another, the articles can not be dispensed through the top wall in a convenient manner.

What is needed is a carton with an insert that facilitates dispensing articles that are horizontally oriented or are otherwise dispensed horizontally. It is desired that the insert protects the articles as articles are removed from the carton through a dispenser opening that is configured to controllably and conveniently dispense the articles.

SUMMARY OF THE INVENTION

The various embodiments of the present invention overcome the shortcomings of the prior art by providing a carton that includes an insert and a dispenser that facilitate dispensing individual ones of an arrangement of articles, which are disposed on their sides, in a convenient manner. The insert also protects the articles as they move in a drop down fashion after an article is dispensed. The articles can be dispensed horizontally through the dispenser formed in a front or end wall of the carton, which is advantageous, for example, when the carton is disposed in a refrigerator and access to the articles through other walls of the carton is limited.

According to one aspect of the invention, each of the exemplary embodiments of the carton is used to form a package that includes a plurality of articles that are disposed on their sides in a matrix arrangement that includes a plurality of rows and at least one column. A lower row of articles, and typically the lowermost row of articles, defines a dispensing position for each column. Upper rows of articles, or rows vertically above the lower row or articles, define descending positions for each column. The carton encloses the articles and includes a detachable portion that is defined by a severance line and that can be at least partially detached along the severance line to form the dispenser that exposes at least the articles in the dispensing positions.

A partition insert is disposed in the carton to insulate the articles from one another and to facilitate dispensing the articles. A first exemplary partition insert includes a longitudinal partition structure that extends longitudinally or vertically alongside a first column of articles. The partition insert also includes a lateral partition structure that extends from the longitudinal partition structure. The lateral partition structure has a length that is greater than the width of the first column such that a separating portion of the lateral partition structure extends substantially laterally (horizontally) and an extending portion of the lateral partition structure extends substantially vertically (longitudinally) or at an angle with respect to the separating portion. The separating portion of the lateral partition structure extends beneath an article in a descending position in the first column of articles.

If an article is removed from the dispensing position of the first column, the articles in the descending positions of the first column descend toward the dispensing position of the first column. The lateral partition structures pivot about an axis that is within a plane defined by the longitudinal partition structure to facilitate the descending movement of, or to lower, the articles in the descending positions toward the dispensing position. As the lateral partition structures pivot, the length of the lateral partition structures ensures that the lateral partition structures maintain an insulating buffer between the articles that are moving from the descending positions toward the dispensing position. Those skilled in the art will recognize that the thickness, length, texture and other characteristics of the lateral partition structure can be varied to provide desired levels of control, according to factors such as the weight and dimensions of each article, the height of the carton, and the fragility of the article.

In certain embodiments, at least part of an extension portion at a distal end of the lateral partition structure is disposed in a face contacting relationship with a wall of the carton or with a divider structure. Thereby, as the lateral partition structure pivots, the distal end or the extension portion of the lateral partition structure frictionally engages the respective wall or divider structure to restrict the rate of descent of an article that is moving from a descending position toward the dispensing position.

In the first exemplary embodiment, the separating portion of the lateral partition structure is proximal to the axis about which the lateral partition structure pivots and the extension portion of the lateral partition structure is distal from the axis about which the lateral partition structure pivots. In alternative embodiments of the partition insert, the separating portion of the lateral partition structure is distal from the axis about which the lateral partition structure pivots and the extension portion of the lateral partition structure is proximal to the axis about which the lateral partition structure pivots.

In the first exemplary embodiment, the axis about which the lateral partition structure pivots is substantially horizontally aligned between adjacent rows of articles. In alternative embodiments, the axis about which the lateral partition structure pivots is substantially horizontally aligned with the center axis of articles in an adjacent row of articles.

In certain embodiments, an article receiving insert is provided that includes a primary panel that includes a plurality of apertures that are positioned to correspond to the matrix arrangement of articles. Each aperture receives the neck or another portion of an article. Certain apertures that are aligned with articles in a longitudinal or vertical column are connected by slits. Thereby, when an article is removed from a dispensing position, the slits define portions of the primary panel that restrict the rate of descent of articles from descending positions toward the dispensing position. Specifically, the portions of the primary panel that are defined by slits frictionally engage the neck portion of an article to slow its descent.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 4 is a perspective view of a partially assembled partition insert that is formed from the partition structures of FIGS. 1 and 2.

FIG. 5 is a perspective view of a carton that includes partition inserts, each formed from the partition structures of FIGS. 1 and 2, the carton enclosing a matrix arrangement of articles that are partitioned by the partition inserts.

FIG. 6 is a front elevation view of the carton and partition inserts of FIG. 5.

FIG. 7 is a plan view of an alternative embodiment of a partition structure that can be arranged to form a partition insert.

FIG. 9 is a front elevation view of the carton and partition inserts of FIG. 8.

DETAILED DESCRIPTION

Figure 1:
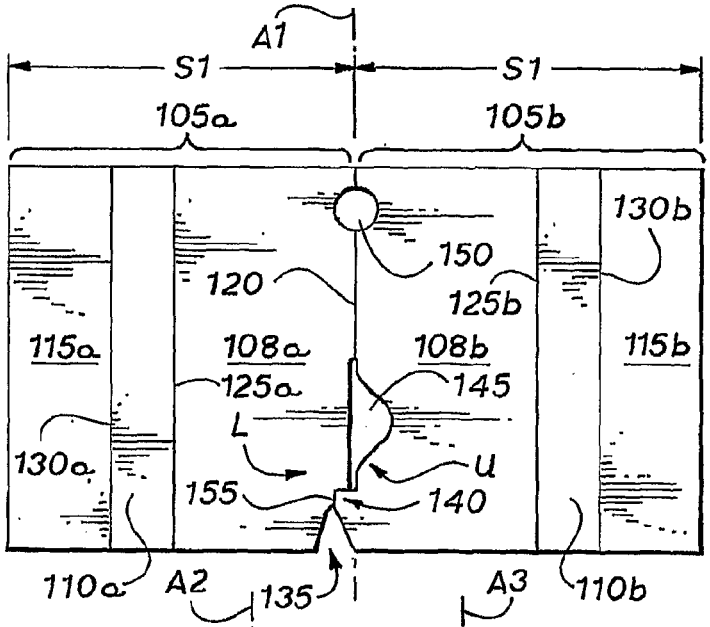
FIGS. 1 and 2 are plan views of exemplary embodiments of a lateral and longitudinal partition structure that can be assembled to form a partition insert.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Further, it will be understood that the present invention is applicable to the storing, carrying, and dispensing of various articles. The term "article" as used herein includes, but is not limited to, bottles, cans, tubes, canisters, and any packaged product or product itself that can be conveniently retained and carried by a carton. The several embodiments of the invention are particularly useful when the articles are fragile or include labels or other exterior embellishment that can be damaged by rolling contact or by impact with other articles.

Referring now to the drawings in which like numerals indicate like elements throughout the several views, the drawings illustrate certain of the various aspects of exemplary embodiments of a package 10 that includes a carton 500 for dispensing an arrangement of articles B. One or more inserts are disposed in the carton to facilitate dispensing the arrangement of articles. The articles are dispensed while stacked on their sides in a drop-down fashion. The inserts provide insulation between adjacent articles as they descend or otherwise control the rate of descent. The insert minimizes the contact between and/or the rate of descent of the descending articles, as described in further detail below.

Generally described, the partition structures that form a partition insert, the divider structures, the article receiving inserts, and the carton blanks described herein are each formed from a foldable sheet material such as paperboard, corrugated board, plastic, combinations thereof, and the like.

For clarity, certain elements that are substantially similar will be designated with like numerals and with an "a" or "b" suffix. Thereby, a description of an element with a suffix "a" can also sufficiently describe a like numbered element with a suffix "b". Accordingly, each of the like elements may not be individually described herein unless such descriptions are useful in understanding the invention.

Figure 2:
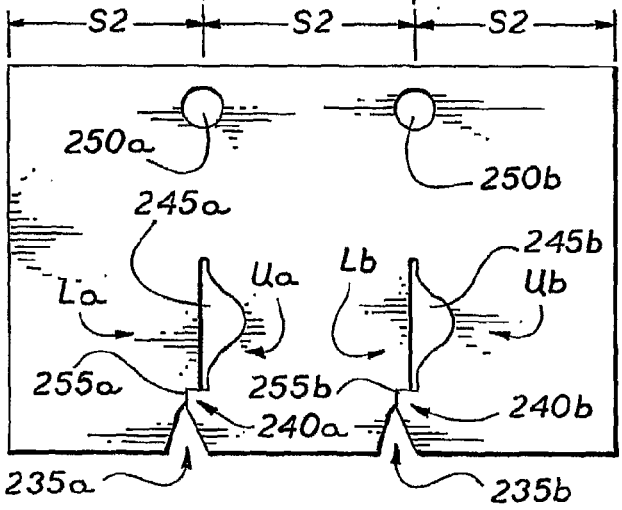

Referring to FIGS. 1 and 2, a partition structure 100 and a longitudinal partition structure 200 can be assembled to form a partition insert, as described in further detail below. Referring to FIG. 1, the partition structure 100 includes panels that are hingedly connected to one another and includes a set of locking elements for engaging a set of locking elements of the longitudinal partition structure 200, to secure the partition structure 100 to the longitudinal partition structure 200. The partition structure 100 includes lateral partition structures 105*a*, 105*b* that are hingedly connected to one another along a medial fold line 120. The length of each lateral partition structure 105*a*, 105*b* is defined by a distance S1 between the fold line 120 and a respective distal end of each lateral partition structure 105*a*, 105*b*.

In the exemplary embodiment, each lateral partition structure 105*a* includes fold lines 125*a*, 130*a* that define a main panel 108*a*, a first extension panel 110*a*, and a second extension panel 115*a*. The first extension panel 110*a* is hingedly connected to the main panel 108*a* along the fold line 125*a* and the second extension panel 115*a* is hingedly connected to the first extension panel 110*a* along the fold line 130*a*. It should be noted that the position of the fold lines 125*a*, 130*a* is a design decision that is at least partially dependent on the dimensions of the articles that are partitioned by the lateral partition structures 105*a* and is additionally dependent on the desired folding locations of the lateral partition structures 105*a* such that the lateral partition structures 105*a* provide the functionality described herein. In alternative embodiments, the fold lines can be alternatively positioned, fold lines can be added or removed, and/or other features can be substituted for the fold lines to facilitate folding the lateral partition structures 105*a*. In yet another alternative embodiment, fold lines 125*a*, 130*a* may be omitted from the lateral partition structures 105*a* and the lateral partition structures 105*a* can flex to provide the functionality described herein. The length of each lateral partition structure is also a design decision that may consider additional factors such as the number of rows and the relative elevation of the lateral partition structure 105*a*.

The partition structure 100 includes a set of locking elements that are substantially aligned along an axis A1 which, in the exemplary embodiment, is defined by the medial fold line 120. The set of locking elements includes a notch 135, a tab 140, a sliding aperture 145, and a receiving aperture 150. The tab 140 is at least partially defined by a cut line 155 that extends from the notch 135 to the sliding aperture 145. The fold line 120 extends between the sliding aperture 145 and the receiving aperture 150 as well as between the receiving aperture 150 and an adjacent edge of the lateral partition 100 such that the receiving aperture 150 interrupts the fold line 120. Sections U, L of the partition structure 100 are located above and below and defined by certain locking elements, including the notch 135, the cut line 155, and the sliding aperture 145, so as to be independently displaceable. Specifically, the certain locking elements define edges the sections U, L.

Referring to FIG. 2, the exemplary longitudinal partition structure 200 includes two sets of locking elements that are aligned along axes A2, A3, respectively. The axes A2, A3 are substantially equally spaced along the length of the longitudinal partition structure 200. Specifically, the axes A2, A3 are spaced from one another and from adjacent edges of the longitudinal partition structure 200 by a distance S2. In alternative embodiments, the longitudinal partition structure 200 can include any number of sets of locking elements. Further, the axes along which the sets are aligned can be positioned along the length of the longitudinal partition structure 200 in any suitable manner to provide the functionality described herein. It is contemplated that the axes are not necessarily equally spaced along the length of the longitudinal partition structure 200. For example, in an alternative embodiment, the distance between adjacent axes is substantially equal to the diameter of an article, and the distance between an endmost axis and the adjacent edge of the longitudinal partition structure 200 is substantially equal to half the diameter of an article. As another example, the distances may vary according to varying diameters of the disparate articles intended to be enclosed in the carton.

Each set of locking elements that is disposed in the longitudinal partition structure 200 is substantially similar to the set of locking elements that is disposed in the partition structure 100. Each set of locking elements that is disposed in the longitudinal partition structure 200 includes a notch 235*a*, a tab 240*a*, a sliding aperture 245*a*, and a receiving aperture 250*a*. The tab 240*a* is at least partially defined by a cut line 255*a* that extends from the notch 235*a* to the sliding aperture 245*a*. Sections Ua, La of the longitudinal partition structure 200 are located above and below and defined by certain locking elements, including the notch 235*a*, the cut line 255*a*, and the sliding aperture 245*a*, so as to be independently displaceable. Specifically, the certain locking elements define edges of the sections Ua, La.

Figure 3:
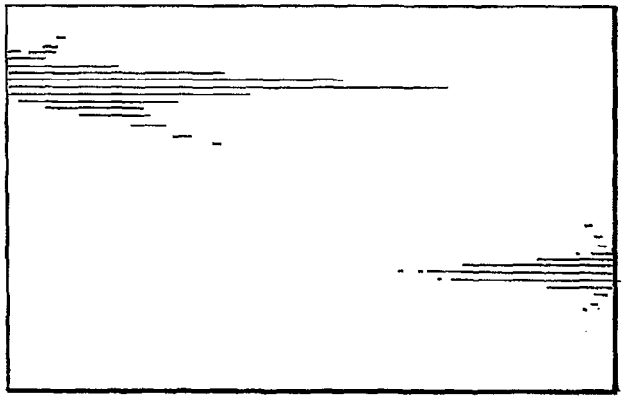
FIG. 3 is a plan view of a divider structure.

Referring to FIG. 3, in certain embodiments that include multiple partition inserts, a divider structure 300 is provided to separate the partition inserts, as described in further detail below.

Referring to FIGS. 1, 2, 4 and 5, two partition structures 100 are attached to a longitudinal partition structure 200 to at least partially form a partition insert 400 that insulates adjacent ones of a matrix arrangement of articles B from one another. According to an exemplary method of assembling the partition structures 100, 200 to form the partition insert 400, the partition structure 100 is oriented to be substantially coplanar to the longitudinal partition 200 such that the axis A1 is substantially aligned with the axis A2 and such that the notch 135 is adjacent to the notch 235*a*. The sections U, L of the partition structure 100 are displaced in opposite directions from the plane defined by the partition structure 100 and the sections Ua, La of the longitudinal partition structure 200 are displaced in opposite directions from the plane defined by the longitudinal partition structure 200. It should be noted that aligning or adjacent sections of the partition structures 100, 200 are displaced in opposite directions. Thereby, the partition structure 100 and the longitudinal partition structure 200 can move toward one another in an interlocking fashion until an innermost edge of the sliding aperture 145 abuts or contacts an innermost edge of the sliding aperture 245*a*. Thereafter, the partition structures 100, 200 overlap one another such that a first surface of the partition structure 100 is in a face contacting arrangement with a first surface of the longitudinal partition structure 200 and a second surface of the partition structure 100 is in a face contacting arrangement with a second surface of the longitudinal partition structure 200. Further, the sections U, L of the partition structure 100 are each returned to an undisplaced position so as to be substantially coplanar with one another and the sections Ua, La of the longitudinal partition structure 200 are each returned to an undisplaced position so as to be coplanar with one another. Thereby, referring to FIG. 4, the tab 140 extends through the receiving aperture 250*a* and the tab 240*a* extends through the receiving aperture 150 to releasably lock the partition structure 100 to the longitudinal partition structure 200. Thereafter, the partition structure 100 and the longitudinal partition structure 200 can be arranged as shown in FIGS. 4 and 5 to form a partition insert 400 that is suitable for inserting between a matrix arrangement of articles B.

As the partition insert 400 is assembled, the partition structure 100 and the longitudinal partition structure 200 are coaxial as the axes A1, A2 are substantially aligned to define a common axis A1/A2. Alternatively described, the axis A1 is substantially within the plane defined by the longitudinal partition structure 200. The lateral partition structures 105*a*, 105*b* can pivot about the axis A1/A2 relative to the longitudinal partition structure 200 to provide the functionality of the partition insert 400. It should be understood that a second partition structure 100 and the longitudinal partition structure 200 are coaxial as the axes A1/A3 are aligned to define a common axis A1/A3.

Referring to FIGS. 5 and 6, an exemplary matrix arrangement of a plurality of articles B are disposed on their sides. The carton 500 is represented by dashed lines so as not to obstruct the features of the partition inserts. The matrix arrangement of article B includes three rows R1, R2, R3 of articles B and four columns C1, C2, C3, C4 of articles B. For purposes of teaching and not limitation, the lowermost row R1 defines a dispensing position P1 for each column C1, C2, C3, C4 and the upper rows R2, R3 define descending positions P2, P3 for each column C1, C2, C3, C4. Further, it should be understood that the matrix arrangement can include any number of rows and columns and the partition inserts 400 can be adapted to accommodate such an arrangement. It is contemplated that any row that is below one or more other rows can define the dispensing position and that the dispensing position may comprise more than one row. Further, different rows can define different dispensing positions for different columns. Each column has a width W that is substantially equal to the diameter of an article B. Alternatively defined, the width W can be substantially equal to the distance between a wall of the carton 500 and a longitudinal partition structure 200 or between a divider structure 300 and a longitudinal partition structure 200.

It should be understood that the partition insert 400 can be arranged in multiple ways and disposed in relation to the arrangement of articles B to provide the functionality described herein. In the exemplary embodiment, the axes A1/A2, A1/A3 are vertically positioned along the length of the longitudinal panel structure 200 so as to be substantially centered between the rows R1, R2 and between rows R2, R3 of articles B, respectively. Accordingly, the distances S2 are substantially equal to the diameter of each of the articles B. Before articles B are dispensed, the main panels 108*a* or otherwise separating portions G1 of the lateral partition structures 105*a* extend substantially horizontally or laterally and beneath articles B in the descending positions P2, P3. The extension panels 110*a*, 115*a* are folded along fold lines 125*a*, 130*a* to partially follow the contour of the side of an article B in one of the descending positions P2, P3. Thereby, distal ends or extension portions G2 of each of the lateral partition structures 105*a* curve or otherwise extend at an angle with respect to the separating portions G1. In the exemplary embodiment, the extension portions G2 extend substantially vertically or upward. This upward extension could be achieved as the insert is loaded into the carton or can be prefolded, such as to facilitate drop loading the insert into a prearranged group of articles.

In the exemplary embodiment, each partition insert 400 is configured to partition an arrangement of two columns C1, C2 and three rows R1, R2, R3 of articles B. Referring to FIGS. 5 and 6, two partition inserts 400 are provided along with the divider structure 300 to partition the exemplary matrix arrangement of articles B. It should be understood that the carton 500 includes a dispenser which provides an opening that exposes at least the articles B in the dispensing positions P1, as described in further detail below. Thereby, the articles B in the dispensing positions P1 can be dispensed.

Referring to FIG. 6, an exemplary method of dispensing articles B from the carton 500 is described. To dispense articles B from the carton 500, articles B can be removed from the dispensing positions P1 in each of the columns C1, C2, C3, C4. Once an article B' is removed from the dispensing position P1 of a column, the articles B", B"' that are initially in the descending positions P2, P3 of that column descend toward the dispensing position P1. The lateral partition structures 105*a* pivot about the axes A1/A2, A1/A3 and unfurl somewhat to allow the articles B", B"' to descend, and partition the articles B", B"' as the article B" is disposed in the dispensing position P1 and the article B"' is disposed in the descending position P2. In the exemplary embodiment, the lateral partition structures 105*a* pivot downward and toward the longitudinal partition structure 200 such that the bottom surface of the article B", B"' that were substantially in contact with the main panels 108*a* or separating portions G1 of the lateral partition structures 105*a* are thereafter substantially in contact with the second extension panels 115*a* or extension portions G2 of the lateral partition structure 105*a*. Referring to FIG. 6, the position of the articles B", B"' in column C3 illustrates the position of the articles in a column after the article B' has been removed.

Continuing the method, another article B" in column C3 can then be removed from the dispensing position P1 such that the article B"' in the descending position P2 in the column C3 descends toward the dispensing position P1 and the lateral partition structure 105*a* that separates the articles B", B"' becomes substantially planar. Referring to FIG. 6, the position of the article B"' illustrates the position of articles in a column after the articles B', B" have been removed in succession from the dispensing position P1 of that column.

Figure 8:
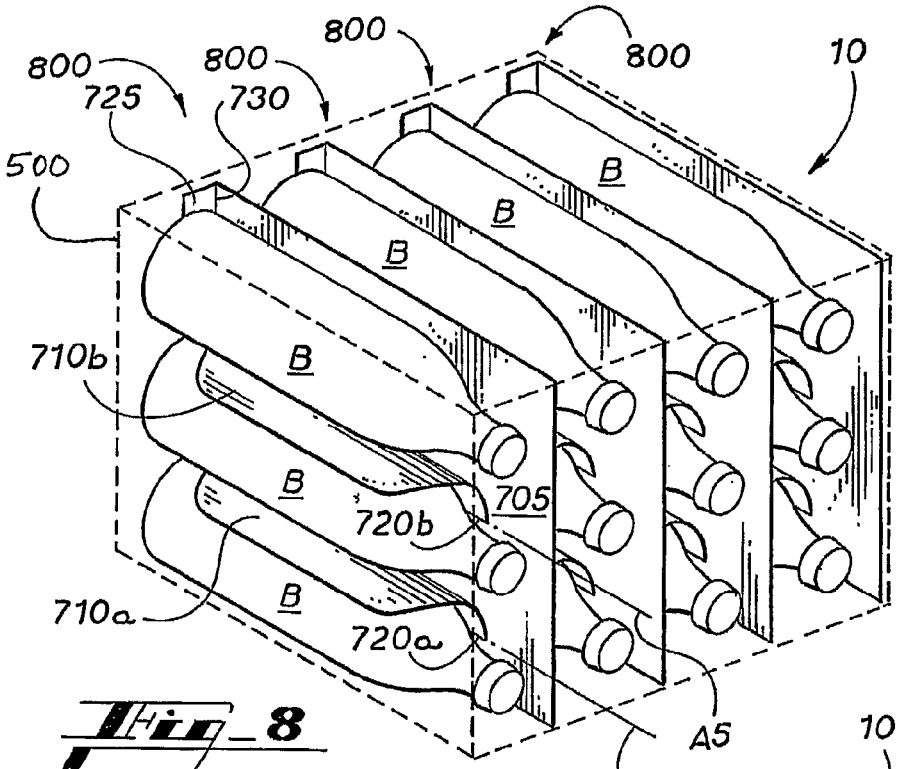
FIG. 8 is a perspective view of a carton that includes partition inserts, each formed from the partition structure of FIG. 7, the carton enclosing a matrix arrangement of articles that are partitioned by the partition inserts.

Referring to FIG. 7, a partition structure 700 is illustrated that it can be arranged to form an alternative embodiment of an insert partition 800 (as shown in FIGS. 8 and 9). The partition insert 800 is somewhat similar to the partition insert 400 and accordingly the description of partition insert 800 will focus on certain differences between the embodiments.

The partition structure 700 includes a longitudinal partition structure 705 and lateral partition structures 710*a*, 710*b* that are struck from the longitudinal partition structure 705. The lateral partition structures 710*a*, 710*b* are defined by cut lines 715*a*, 715*b* and by fold lines 720*a*, 720*b*, respectively. The lengths of each of the lateral partition structures 710*a*, 710*b* are defined by the distance S3 between the fold lines 720*a*, 720*b* and the distal ends of the lateral partition structures 710*a*, 710*b*. The partition structure 700 further includes an edge flap 725 which is hingedly connected to the longitudinal partition structure 705 along a fold line 730. The edge flap 725 facilitates securing the partition structure 700 to a wall of the carton 500. It is contemplated that an edge flap 725 can be appended along any one or more of the edges of the partition structure 700 and can extend along less than its entire length.

The partition structure 700 can be arranged to form the partition insert 800 and disposed between the exemplary matrix arrangement of articles B, as shown in FIGS. 8 and 9. The fold lines 720*a*, 720*b* define axes A4, A5 about which the lateral partition structures 710*a*, 710*b* can pivot with respect to the longitudinal partition structure 705. In this embodiment, the axes A4, A5 are positioned along the length of the longitudinal panel structure 705 so as to be substantially aligned with the centers of articles in rows R1, R2 of the exemplary matrix arrangement of articles B. For example, the axis A4 is offset from the bottom edge of the longitudinal partition structure 705 by a distance S4, which can be substantially equal to half of the diameter of an article B, and the axis A5 is offset from the axis A4 by a distance S5, which can be substantially equal to the diameter of an article B. Extension portions G3 of the lateral partition structures 710*a*, 710*b* extend substantially vertically upward from the axes A4, A5 and separating portions G4, located at distal ends of the lateral partition structures 710*a*, 710*b*, extend substantially horizontally or laterally and beneath articles B in descending positions P2, P3. The lateral partition structures 710*a*, 710*b* flex, bend, or are otherwise folded to partially follow the contour of the side of articles B in one of the descending positions P2 or the dispensing position P1. For example, in the exemplary embodiment, the lateral partition structures 710*a*, 710*b* bend around the upper side surface of an article B that has a center axis K which is horizontally aligned with the axis A4, A5 of the lateral partition structure 710*a*, 710*b*. To slow the rate of descent, it is preferable that the lateral partition structures be formed from a material that has a certain plasticity or is otherwise deformable so as to tend to maintain this curvature until an opposing force, i.e., the descending article, forces it to bend the other way. In other applications, it may be desirable, on the contrary, to propel the articles downward, in which case a material with greater elasticity may be used.

Referring to FIG. 9, the articles B can be removed from dispensing positions P1 and dispensed from the carton 500 in a manner that is substantially similar to that described herein. Further, the movement of the articles B and the lateral partition structures 710*a*, 710*b* are somewhat similar. In this embodiment, once an article B' is removed from a dispensing position P1, articles B", B'" that are located in the dispensing positions P2, P3 descend. The lateral partition structures 710*a*, 710*b* pivot downward about the axes A4, A5 such that the bottom surfaces of the articles B", B'" remain substantially in contact with the separating portions G4 of the lateral partition structures 710*a*, 710*b*, respectively, and the articles B", B'" are continually separated by the separating portion G4 of the lateral partition structure 710*b*.

Figure 10:
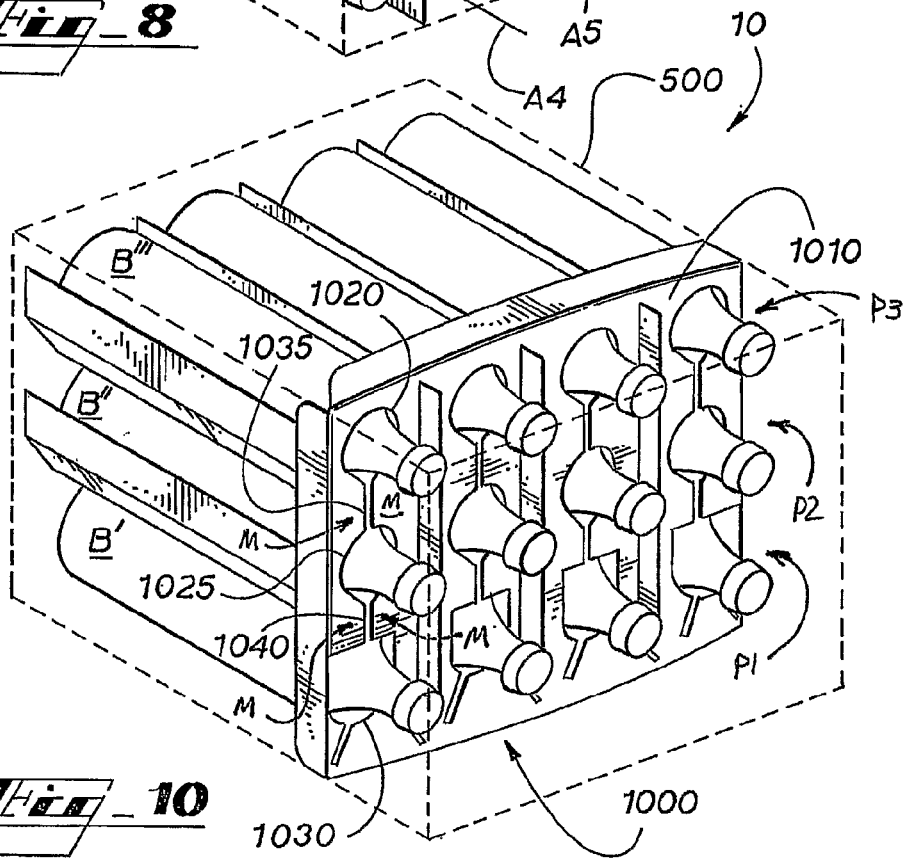
FIG. 10 is a perspective view of a carton that includes an exemplary article receiving insert.

Referring to FIG. 10, in certain embodiments, an article receiving insert 1000 is provided to slow the descent of articles B, or otherwise lower articles B in a controlled manner as they are removed from dispensing positions P1 or otherwise dispensed from the carton 500, as will be described in more detail below. The article receiving insert 1000 includes a primary panel 1010 with multiple apertures that are positioned to correspond to the articles B of the matrix arrangement of articles B. The insert panel includes edge flaps 1015 that are hingedly connected to the primary panel 1010 such that the article receiving insert 1000 can be attached to the walls of the carton 500. In alternative embodiments, the article receiving insert 1000 defines, or is integral to, a wall of the carton 500. Specifically, each aperture substantially aligns with the center axis K of a respective article B. The articles B are at least partially inserted through or otherwise received by a respective aperture. Apertures that are vertically aligned and correspond to articles in a column C are connected by slits. Each group of vertically aligned apertures is substantially similar and therefore only one of the groups will be described in detail. In the exemplary embodiment, a top aperture 1020 aligns with an article B'" in a descending position P3, a middle aperture 1025 aligns with an article B" in a descending position P2, and a bottom aperture 1030 aligns with an article B' in a dispensing position P1. The top aperture 1020 is connected to the middle aperture 1025 by a slit 1035. The middle aperture 1025 is connected to the bottom aperture 1030 by a slit 1040.

The illustrated slits 1035, 1040 are linear, although it is contemplated that curved or otherwise contoured slits may to used to further dampen the downward motion of the articles B. Further, the width of the slits 1035, 1040 may be infinitesimal or substantial to control the rate of descent of articles B.

Once an article B' in a dispensing position P1 is dispensed through an aperture 1030, the necks or portions of the articles B", B'" that are inserted through the apertures 1020, 1025 are frictionally engaged by portions M of the primary panel 1010 that are defined by the slits 1035, 1040 as the articles B", B'" descend through a path defined by the slits 1035, 1040 or otherwise move toward the dispensing position P1.

The carton 500 is further described to teach provision of exemplary detachable portions that can be used conjunction with the partition inserts and/or the article receiving insert to dispense articles in a drop down fashion from the carton 500. The carton 500 includes a top wall 505, a bottom wall 510, a rear side wall 515, a front side wall 525, and end walls 520, 530. It should be noted that the carton 500 is disposed on its bottom wall in an upright condition, with the articles standing upright to transport and store the articles. The carton 500 is disposed on the front side wall 525, which is adjacent the row R1 of articles that defines the dispensing positions P1, to dispense the articles B.

Figure 11:
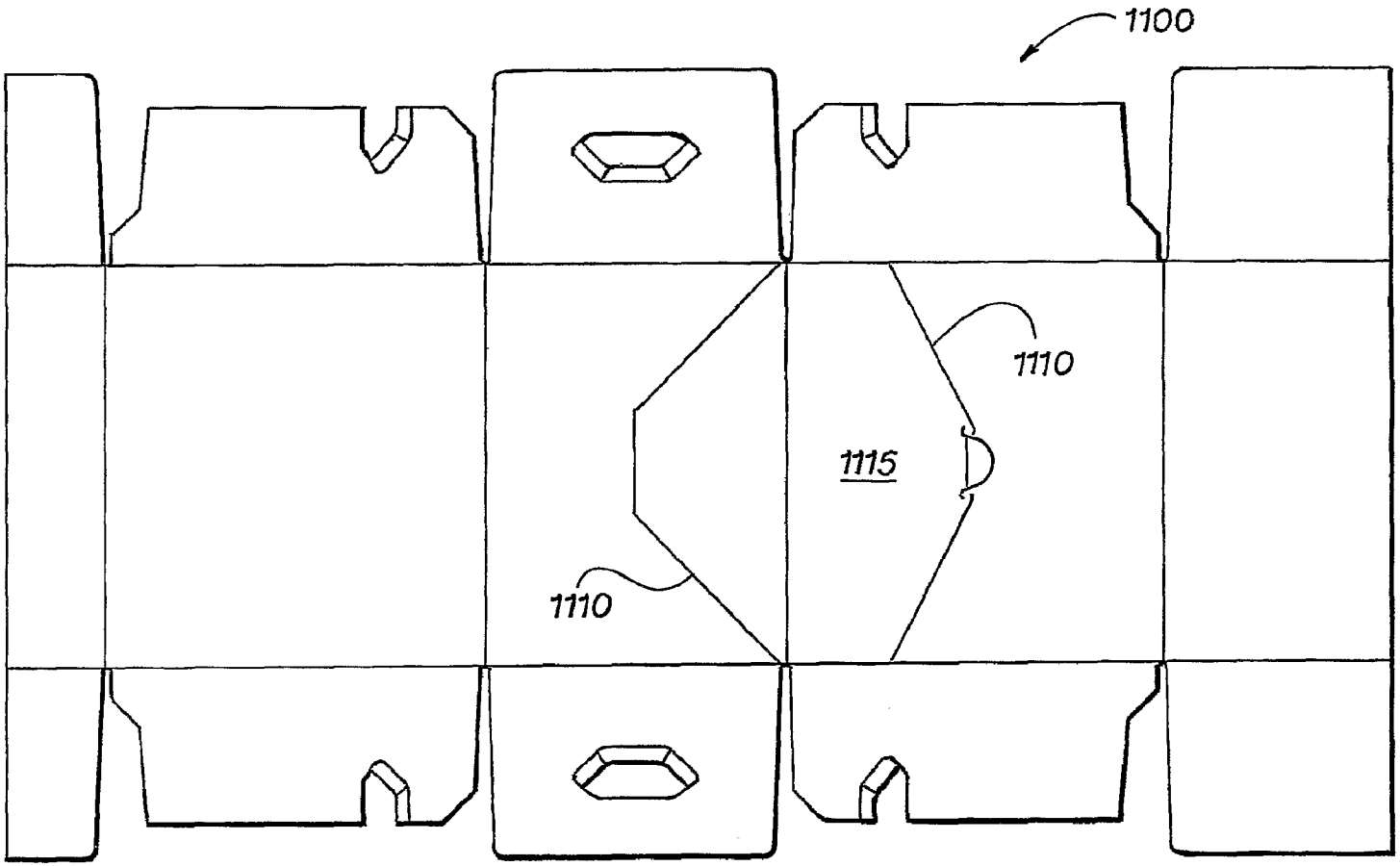
FIG. 11 is a plan view of a blank for forming a carton that includes an exemplary embodiment of a dispenser, according to the present invention.
Figure 12:
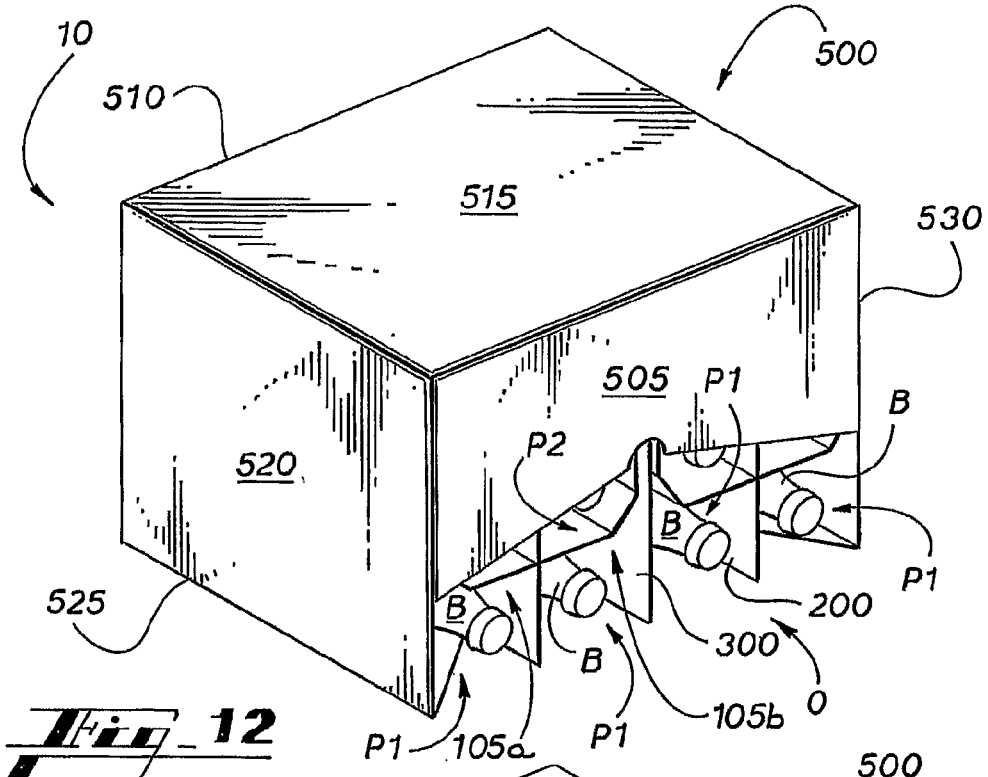
FIG. 12 is a perspective view of a carton formed from the blank of FIG. 11.

Referring to FIGS. 11 and 12, a blank 1100 includes panels that are hingedly connected to one another and that can be folded and secured to form the carton 500. Specifically, certain of the panels define at least a portion of a wall of the carton. The method for assembling such a blank is understood by those skilled in the art and will not be described. The blank 1100 includes severance lines 1110 that at least partially define a detachable portion 1115. In the exemplary embodiment, the severance line 1100 extends across the blank 1100 such that, after the blank 1100 is folded and secured to form the carton 500, the detachable portion 1115 includes at least a portion of the top wall 505 and at least a portion of the front side wall 525. Thereby, the detachable portion 1115 can be detached to provide an opening O that facilitates accessing the end of an article from the side of the carton 500 as well as below the carton 500, for example, if the carton 500 is situated to extend over an edge.

Figure 14:
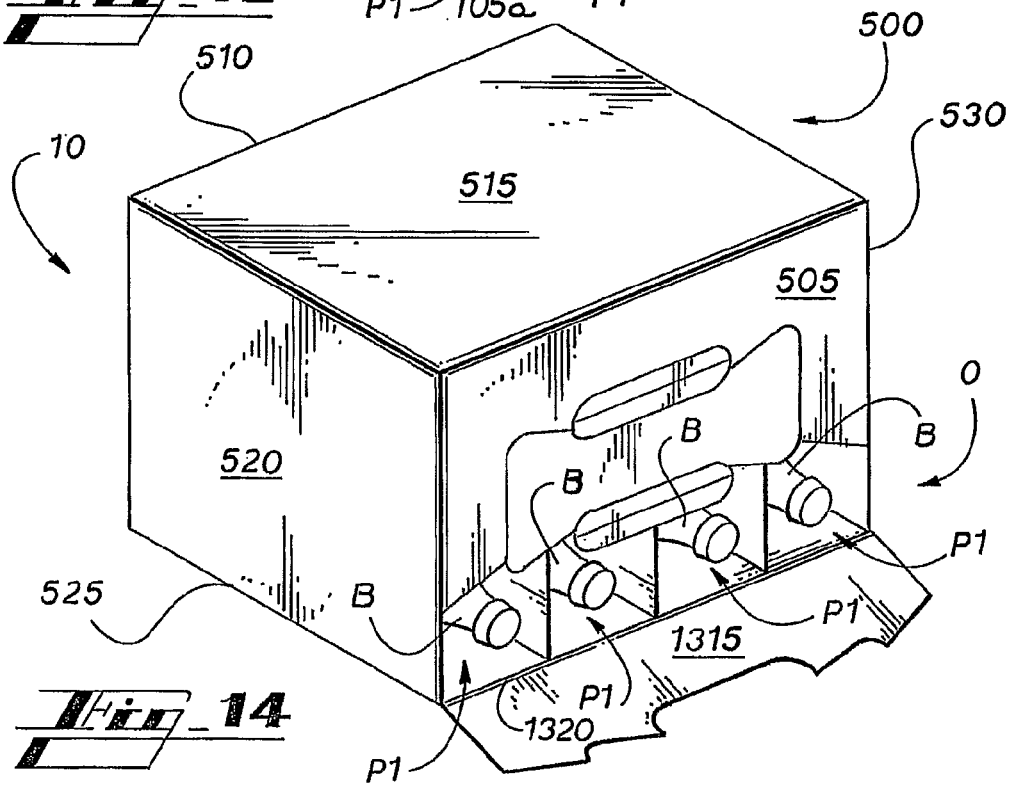
FIG. 14 is a perspective view of a carton formed from the blank of FIG. 13.
Figure 13:
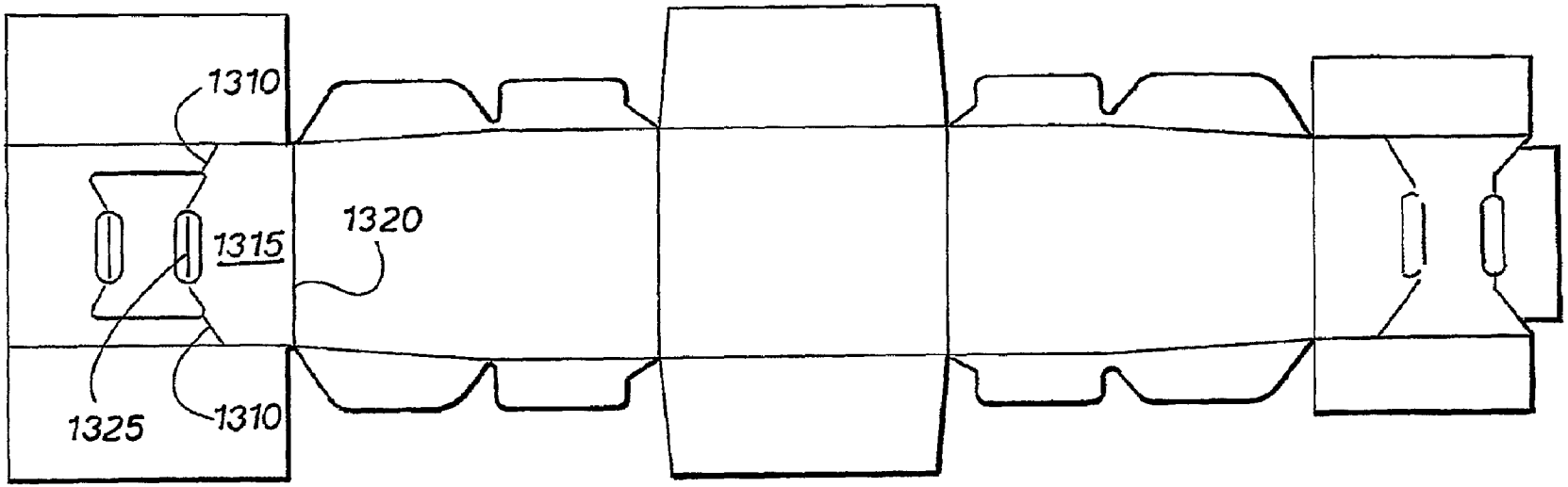
FIG. 13 is a plan view of a blank for forming a carton that includes an alternative embodiment of a dispenser.

Referring to FIGS. 13 and 14, an alternative embodiment of a blank 1300 for forming the carton 500 includes severance lines 1310 that define a detachable portion 1315. The detachable portion 1315 includes a portion of the top wall 505 and is defined by a fold line 1320 so as to be hingedly connected to the front side wall 525. The top wall 505 further includes a handle aperture 1325 that at least partially defines the detachable portion 1315 and provides means for engaging the detachable portion 1315 to separate the detachable portion 1315 from the carton 500 along the severance lines.

It should be understood that the severance lines 1110, 1310 do not necessarily extend to the end walls 520, 530. Rather, the path of the severance line or lines that define a detachable portion is a design choice so long as the detachable portion is at least partially detachable to provide an opening that exposes the articles B of the matrix arrangement of articles B that are located in dispensing positions P1.

The partition inserts described herein can include lateral partition structures that are spring loaded or otherwise tend to pivot or straighten to apply a force to an article that is beneath the lateral partition structure to facilitate dispensing articles. It is contemplated that such a tendency can be achieved by selecting a suitable material and formation process to produce such a partition insert or by adding elements such as rotational springs or leaf springs to the partition insert. Such a function is useful in applications where the articles are lightweight or otherwise do not provide the force that is required to pivot the lateral partition structure to properly dispense the articles. For example, such articles may become stuck in the carton or otherwise descend slowly.

It is contemplated that a severance line includes, but is not limited to, perforations, a line of perforations, a line of short slits, a line of half cuts, a single half cut, any combination of perforations, slits, and half cuts, short score lines, or the equivalent.

The above-described embodiments are merely exemplary illustrations of implementations set forth for a clear understanding of the principles of the invention. Many variations and modifications may be made to the above-described embodiments without departing from the scope of the claims. All such modifications, combinations, and variation are included herein by the scope of this disclosure and the following claims.

The invention claimed is:

1. A package, comprising:

a plurality of articles disposed on sides thereof in a matrix arrangement including a plurality of laterally orientated rows and at least a first longitudinally orientated column, the laterally oriented rows including a lowermost row defining a first lowermost position in said first longitudinally oriented column, a second lowermost row disposed above the lowermost row, said second lowermost row defining a second lowermost position in said first longitudinally oriented column, and a third lowermost row disposed above the second lowermost row, the third lowermost row defining a third lowermost position in said first longitudinally oriented column;

a carton for enclosing said articles; and a partition insert disposed at least partially inside said carton, the partition insert for insulating said articles from one another and for facilitating dispensing of said articles, said partition insert comprising:

a longitudinal partition structure extending longitudinally alongside said first longitudinally oriented column of articles; and at least one lateral partition structure connected to said longitudinal partition structure for movement from an initial partitioning position where said at least one lateral partition structure is disposed substantially laterally between the second and third lowermost positions in said first longitudinally oriented column to a second partitioning position where said at least one lateral partition structure is disposed substantially laterally between the first and second lowermost positions in said first longitudinally oriented column such that said at least one lateral partition structure moves from the initial partitioning position to the second partitioning position when an article in the first longitudinally oriented column descents from the third lowermost position to the second lowermost position.

2. The package of claim 1, wherein said at least one lateral partition structure comprises a flap having a length that is greater than the width of said first longitudinally oriented column.

3. The package of claim 1, wherein said at least one lateral partition structure is connected to the longitudinal partition structure for pivotal movement about an axis, and the axis is substantially within a plane defined by the longitudinal partition structure.

4. The package of claim 3, wherein the axis is defined by a fold line.

5. The package of claim 3, wherein said at least one lateral partition structure comprises a separating portion and an extension portion that extends at an angle with respect to said separating portion.

6. The package of claim 5, wherein said separating portion of the at least one lateral partition structure is proximal to the axis and the extension portion of the at least one lateral partition structure is distal from the axis.

7. The package of claim 5, wherein the separating portion of the at least one lateral partition structure is distal from the axis and the extension portion of the at least one lateral partition structure is proximal to the axis.

8. The package of claim 3, wherein the axis is located at an elevation between the second and third lowermost positions.

9. The package of claim 3, wherein the axis is horizontally aligned with the center axes of the articles in the second lowermost row.

10. The package of claim 1, wherein the carton includes detachable portion that can be at least partially detached from the carton to provide a dispensing opening that exposes an articles in the first lowermost positions in the first longitudinally oriented column.

11. The package of claim 10, wherein the detachable portion is defined by a severance line.

12. The package of claim 5, wherein:

said carton comprises a pair of end walls extending longitudinally on either side of the matrix arrangement of articles; and said extension portion of at said at least one lateral partition structures is in frictional contact with one of said end walls so as to control the rate of descent of an article from the third lowermost position toward said second lowermost position.

13. Tile package of claim 1, wherein the matrix arrangement further includes a second longitudinally oriented column, and said at least one lateral partition structure comprises a plurality of lateral partition structures, one of the lateral partition structures being movably connected to said longitudinal partition structure and disposed within the second longitudinally oriented column.

14. The package of claim 1, wherein said partition insert comprises control means for controlling the rate of descent of an article from the third lowermost position toward said second lowermost position.

15. The package of claim 14, wherein said control means controls said rate such that said rate is either increased or decreased.

16. The package of claim 1, wherein the at least one lateral partition structure is connected to the longitudinal partition structure for further movement from the second partitioning position to a third position where said at least one lateral partition structure is disposed substantially along said longitudinal partition structure such that said at least one lateral partition structure moves from the second partitioning position to the third position when an article in the first longitudinally oriented column descents from the second lowermost position to the first lowermost position.

17. A package, comprising:

a carton;

a plurality of articles disposed on sides thereof within said carton in a matrix arrangement including at least a first longitudinally orientated column and a plurality of laterally orientated rows, a lower row defining a dispensing position in said first column, at least one upper row, each upper row defining a descending position in said first column, the descending positions being disposed above the dispensing position;

an article receiving insert, comprising:

a plurality of dispensing apertures positioned to correspond to said matrix arrangement of said articles, each dispensing aperture being for receiving at least a portion of one of said articles; and a substantially longitudinal slit connecting adjacent apertures that correspond to articles in said first column;

wherein portions of the article receiving insert that are defined by said slits are for controlling the rate of descent of said articles moving from said descending positions toward said dispensing position if an article is removed from said dispensing position of said first column.

18. The package of claim 17, said aperture that is aligned with said dispensing position is sufficiently large so as to permit removal of an article therethrough.

* * * * *